United States Patent [19]

LaBoda

[11] 4,111,761

[45] Sep. 5, 1978

[54] METHOD AND APPARATUS FOR FLOW-THROUGH PLATING INCLUDING PNEUMATIC ELECTROLYTE SHUTTLING SYSTEM

[75] Inventor: Mitchell A. LaBoda, East Detroit, Mich.

[73] Assignee: General Motors Corporation, Detroit, Mich.

[21] Appl. No.: 848,926

[22] Filed: Nov. 7, 1977

[51] Int. Cl.[2] ..... C25D 5/08; C25D 17/00; C25D 21/10

[52] U.S. Cl. ..... 204/26; 204/222; 204/273; 204/275

[58] Field of Search ..... 204/222, 273, 275–278, 204/26

[56] References Cited

U.S. PATENT DOCUMENTS

| | | | |
|---|---|---|---|
| 3,022,232 | 2/1962 | Bailey et al. | 204/36 |
| 3,065,153 | 11/1962 | Hough et al. | 204/26 |
| 3,276,978 | 10/1966 | Spaulding et al. | 204/45 R |
| 3,499,830 | 3/1970 | Haggerty et al. | 204/224 |

OTHER PUBLICATIONS

A. Kenneth Graham, "Electroplating Engineering Handbook", p. 621, (1955).

*Primary Examiner*—G. L. Kaplan
*Attorney, Agent, or Firm*—Lawrence B. Plant

[57] ABSTRACT

Flow-through plating apparatus and method particularly effective for the high speed plating and building up of Pb-Sn alloy on bearing shells. An open-ended, flow-through plating cell having a reciprocating anode is provided with a pneumatic electrolyte shuttling system for transferring electrolyte back and forth through the cell in timed relation to the motion of the anode. The surface to be plated is in a recess whose lateral walls are non-conductive to shield the shell ends from overplating.

5 Claims, 1 Drawing Figure

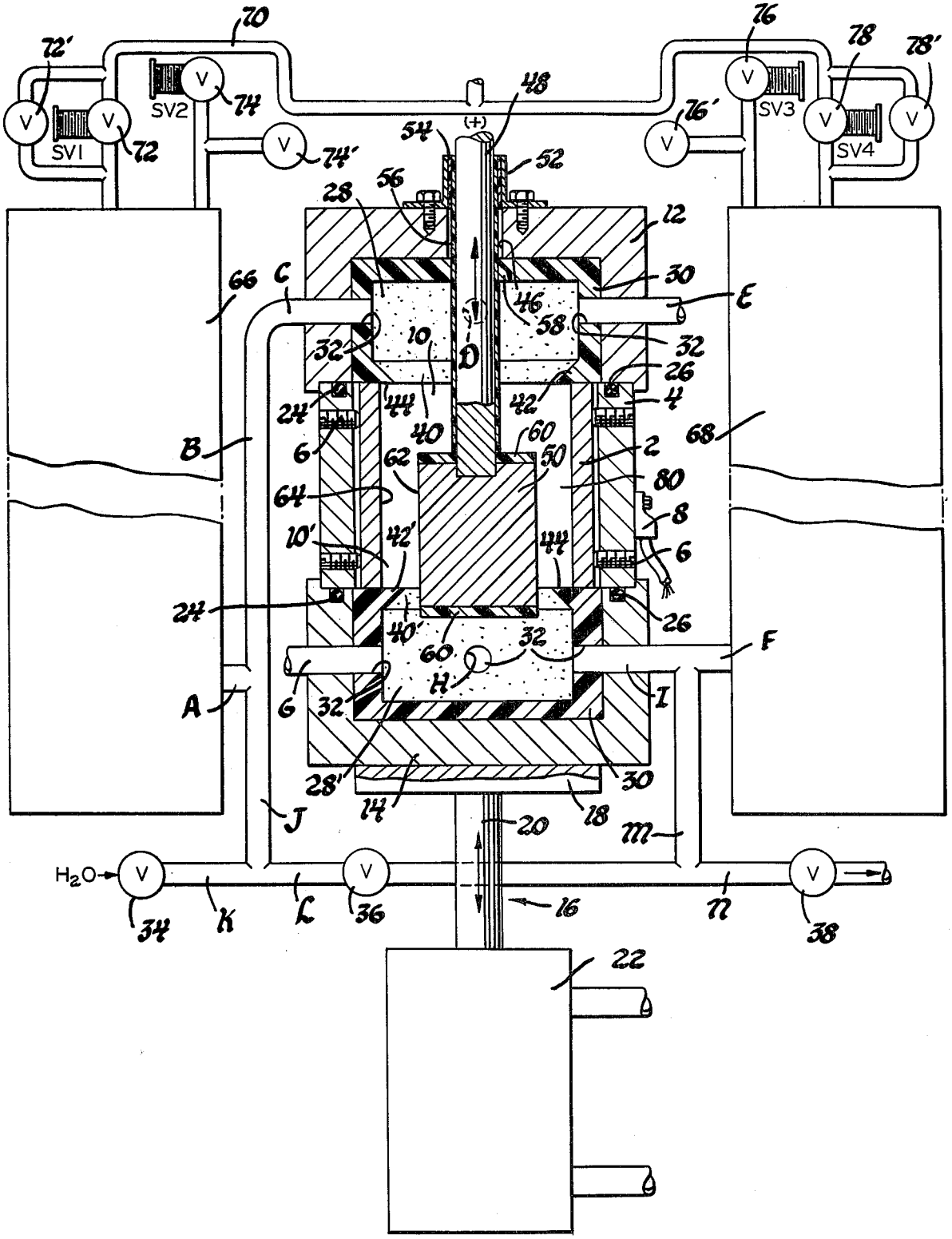
SV1
SV2
SV3
SV4
V
(+)
(-)
$H_2O$

METHOD AND APPARATUS FOR FLOW-THROUGH PLATING INCLUDING PNEUMATIC ELECTROLYTE SHUTTLING SYSTEM

BACKGROUND OF THE INVENTION

This invention relates generally to high rate, electroplating apparatus of the flow-through type in which corrosive electrolyte is forced at a constant rate through the interelectrode gap so as to provide fresh (i.e., cation-rich) electrolyte to the plating zone. In such systems, electrolyte flow additionally purges the electrodes of any polarizing films, etc. which tend to limit the plating rate. Representative such systems employing both fixed and reciprocating anodes are disclosed in Spaulding U.S. Pat. No. 3,276,978, Hough et al. U.S. Pat. No. 3,065,153 and Bailey et al. U.S. Pat. No. 3,022,232.

More specifically, the present invention relates primarily to the handling of corrosive electroplating electrolytes in flow-through electroplating systems for building up thick deposits and has for its principal object the elimination of conventional mechanical circulating pumps with all their maintenance, operational and declining performance problems (i.e., resulting from mechanical and corrosive deterioration of seals, clearances, etc.) while at the same time providing a simple, long-lived and readily variable high flow rate system for moving electrolyte at constant volumetric flow through the plating cell. This and other objects and advantages of the present invention will become more evident from the detailed description thereof which follows and wherein the FIGURE illustrates (i.e., in a partially sectioned elevational view) one embodiment of the system of the invention.

BRIEF DESCRIPTION OF THE INVENTION

The subject invention comprehends a flow-through electroplating apparatus and method of operating same wherein the electrolyte is pneumatically shuttled between two reservoirs and through the plating cell by alternately pressurizing one reservoir while venting the other so as to expel the electrolyte from the pressurized reservoir and into the vented one. The flow rate from one reservoir to the other may be varied simply by changing the air pressure applied to the system and hence an almost infinitely variable system is available in contrast to one which is limited by pump capacity. Electrolyte shuttling continues throughout the plating cycle and until a sufficiently thick deposit is built up on the workpiece. In a preferred embodiment, the plating cell employs a reciprocating anode and electrolyte flow through the cell is reversed, which is so timed as to occur at the end of each stroke of the anode when plating is at a minimum. This tends to minimize any unevenness that might otherwise occur due to any turbulence generated during flow reversals occurring mid-stroke. Excessive build-up on the ends of the workpiece is avoided by locating the plating surface in a recess having nonconductive current shielding walls. In a most preferred embodiment, flow reversal is such as to cause the electrolyte to flow in a direction opposite to the direction the anode moves through the plating cell. This insures that the leading end of the anode always sees the freshest electrolyte before there is any cation depletion which provides a more desirable current distribution in the gap between the anode and the workpiece.

DETAILED DESCRIPTION OF ONE EMBODIMENT OF THE INVENTION

The FIGURE depicts a high speed, flow-through plating system for building up in excess of 100 μm of Pb-Sn bearing alloy (i.e., about 10% Sn) on the inside diameter of a cylindrical steel, diesel bearing shell 2. By this invention a very smooth Pb-Sn deposit is formed even at these thicknesses and plating rates in contrast to the rough, noduled and treed surface obtained with conventional still tank plating systems.

The workpiece or bearing shell 2 is positioned centrally in a larger diameter cylindrical plating cell enclosure 4 by means of set screws 6 or the like. Current is conducted to and from the shell 2 through the set screws 6 and the enclosure 4 which is connected to an appropriate electrical source (e.g., rectifiers) through the negative contact lead 8. The ends 10–10' of cell enclosure 4 are open to permit flow of electrolyte directly therethrough along the central longitudinal axis of the cell enclosure 4 and bearing shell 2. Upper and lower caps 12 and 14, respectively, are forced into sealing engagement with the ends of the cell enclosure 4 by means of the hydraulically actuated elevator 16 and serve to both supply and receive electrolyte to and from the cell 4.

The upper cap 12 is fixedly mounted to a stand or support (not shown) and the lower cap 14 rests on a support tray 18 of the elevator 16. The support tray 18 is raised and lowered via the shaft 20 and hydraulic piston 22 during opening and closing (i.e., loading and unloading) of the fixture. O-rings 24 in appropriate slots 26 formed in the upper ends of the lower cap 14 and the cell enclosure 4 prevent electrolyte leakage at the cap-enclosure interface. The caps 12 and 14 themselves are substantially identical in that each has a Lucite insert or lining 30 defining an electrolyte chamber 28. Openings 32 are provided approximately 90° apart around the periphery of the chamber 28 for admitting electrolyte to or removing electrolyte from the chambers 28, as appropriate, during plating. Conduits A-I provide the primary plumbing network for directing electrolyte flow in the system. Flexible conduits (e.g., high pressure hose) is required for the bottom cap 14 to permit opening and closing as discussed above. A secondary plumbing system including conduits J-N and manual valves 34, 36 and 38 is provided for flushing and/or draining of the system in a manner which is readily apparent from the drawing and requires no further description.

The chambers 28 are open to the cell enclosure ends 10–10' through the chamber mouths 40–40', respectively. The periphery of the mouths 40–40' is defined by inward extending annular lips 42–42' formed on the Lucite inserts 30. This lip 42 extends radially inwardly of the surface 64 being plated such that the surface 64 is in a recess defined in part by the nonconductive Lucite walls 44 so as to provide half-box-like shielding for the ends of the shell 2 which tends to promote a more uniform current distribution at the shell ends where higher current concentration sites would otherwise exist.

The upper cap 12 is provided with a bore 46 for permitting axial movement of a shaft 48 therethrough which shaft 48 drives the anode 50 up and down within the cell enclosure 4 and bearing shell 2. A sealing collar 52 is bolted to the cap 12 and is lined with a solid fluorinated hydrocarbon such as polytetrafluoroethylene (i.e., Teflon) 54. Similarly, the shaft 48 is coated with Teflon 56. The Teflon 56 on the shaft 48 riding within the Teflon 54 of the collar 52 provides a low drag, electrolyte seal within the collar 52. Alternatinely, an O-ring sealed collar arrangement would also be acceptable. A close fit at 58 between the Teflon layer 56 and the lucite 30 provides some additional sealing.

The anode 50 may comprise a nonconsumable metal, but in the present embodiment comprises a consumable lead-tin alloy in which the tin content is about 10% by weight. The anode 50 is attached to the end of the anode drive shaft 48 by any convenient means (e.g., threads), and has its ends provided with lucite shields 60 to prevent any stray current migration from the ends of the anode 50. This effectively concentrates the current flow on the anode face 62 immediately adjacent the surface 64 which is to be plated.

The face of the anode 62 is smaller areawise than the surface 64 being plated. Likewise, the axial length of the anode 50 is shorter than the axial length of the workpiece/bearing shell 2. As a result, it is necessary to reciprocate the anode 50 up and down within the bearing shell 2 so that it completely traverses the surface 64 and thereby insures uniform coverage thereof. Appropriate means (not shown) are provided for supplying the reciprocating motion required. By thusly using a smaller anode 50 and traversing the surface 64, higher anode current densities can be achieved with smaller rectifiers yet high deposition rates are still achieved on the surface 64 immediately adjacent the face 62 of the anode 50. In this regard, reciprocation of the smaller anode 50 causes the high current density pattern to sweep the surface 64 of the workpiece/shell 2, and thereby incrementally deposit the lead-tin bearing material thereon. The number of sweeps and the current density then determines the thickness of the deposit since with the electrolyte flow there is no significant electrolyte concentration or polarization limitations to contend with.

Electrolyte is pumped through the plating fixture by a pneumatic system which shuttles the electrolyte through the plating cell 2 and back and forth between the reservoirs 66 and 68 via the conduits A–I. In operation, reservoir 66 and the plating cell 2 are initially filled with electrolyte while considerable void space is provided in reservoir 68. The air supply line 70 is pressurized from an appropriate air source (not shown) and the sequence is ready to begin. With the flush and drain valves 34, 36 and 38 closed, the normally-open, solenoid-operated vent valve 74 is closed and the normally-closed, solenoid-operated air pressure valve 72 opened so that air from line 70 may enter and pressurize the reservoir 66 thereby depressing the electrolyte level therein and forcing it through conduits A, B, C, D and E into the chamber 28 of upper cap 12. From the cap 12, the electrolyte passes through the cell enclosure 4, around the anode 50, through the interelectrode gap 80 (i.e., between the anode 50 and the bearing 2), into the chamber 28′ of lower cap 14 and thence to reservoir 68 via conduits G, H, I and F. When sufficient electrolyte has been transferred from reservoir 66 to reservoir 68, the procedure is reversed. To effect this, the air pressure valve 72 is closed and the vent valve 74 opened to relieve the pressure in reservoir 66. Shortly thereafter (i.e., controlled by timers), the normally-open, solenoid-operated vent valve 76 is closed and the normally-closed, solenoid-operated air pressure valve 78 is opened to admit air from the line 70 to the top of reservoir 68. The air pressure depresses the electrolyte level in the reservoir 68 forcing it back through conduits F, G, H and I, into chamber 28′ of lower cap 14, upwardly through the interelectrode gap 80, into the chamber 28 of the upper cap 12, and out the conduits C, D and E for return to reservoir 66 via conduits B and A.

The solenoid-operated valves permit automatic operation of the system as by means of appropriate timers and the sequence is repeated over and over throughout the plating cycle until the requisite amount of deposit is formed on the surface 64 of the workpiece 2. While automatic control is preferred, the system is also plumbed with appropriate manual valves 72′, 74′, 76′ and 78′ to permit manual operator sequencing of the above system.

In a particularly preferred mode of operating the system, the shuttling of the electrolyte back and forth between the reservoirs 66 and 68 is accomplished in timed relation to the reciprocation of the anode 50. In this embodiment, limit switches (not shown) are provided in conjunction with the shaft 48 to sense the upper and lower end of each stroke of the anode 50. At the end of each stroke, the electrolyte flow is reversed. In a most preferred embodiment the electrolyte reversal is such that the electrolyte always flows countercurrent (i.e., in the opposite direction) to the anode movement.

In one specific embodiment of the invention, a steel bearing shell having an inside diameter of 19.05 centimeters and a length of about 15.24 centimeters is plated with 190 micrometers of lead-tin alloy bearing material (i.e., 10% tin) from 90 liters of a 54° C. plating solution comprising about 200 grams per liter lead fluoroborate, 50 grams per liter tin fluoroborate, 100 grams per liter fluoroboric acid, 20 grams per liter boric acid and 2.3 grams per liter hydroquinone. The anode comprises 90% lead and 10% tin, is initially spaced from the bearing shell by about 2.54 centimeters and reciprocated in the cell 2 at the rate of about 0.58 cm/sec. The electrolyte is passed through the plating cell at a rate of about 100 liters per minute resulting from an applied air pressure to the reservoirs of about 4.8 atmospheres. About 9 minutes at about 325–350 amperes and an applied potential of about 5–10 volts are required to deposit the 190 μm. This is contrasted with a conventional still tank plating time of about 120 minutes to achieve the same thickness.

While the invention has been described in terms of a specific embodiment thereof, it is to be appreciated that many variations thereof are possible within the normal skill of the plater. In this regard, the pneumatic shuttling system of the present invention may be used with fixed anodes as well as with anodes whose entire surface is adjacent the surface to be plated throughout the plating cycle. Moreover, appropriate plumbing arrangements may be made whereby the electrolyte is shuttled back and forth between the reservoirs but always passes through the plating cell in the same direction. Hence, while there are advantages to reversing the direction of the flow of electrolyte through the cell and to timing the flow reversal and direction thereof to the movement of a reciprocating anode, the invention in its broadest sense is not limited to such an embodiment. Lastly, the anode might well be fixed and the cathode reciprocated without departing from the substance of the present invention. Hence, it is not intended that this invention be limited to the specific embodiment employed to illustrate it, but rather only to the extent set forth hereafter in the claims which follow.

The embodiments of the invention in which an exclusive property or privilege is claimed are defined as follows:

1. In electroplating apparatus for the rapid deposition of metal on the surface of a workpiece including, an open ended electroplating cell adapted to permit electrolyte flow therethrough, means for positioning a workpiece in said cell, means for positioning an anode in said cell in spaced relation to said workpiece such as to provide a gap therebetween through which electrolyte can flow during plating, and inlet and outlet means for continuously supplying and withdrawing electrolyte to and from said cell, the improvement comprising:

a pneumatic system for shuttling electrolyte between said inlet and outlet means and through said gap during plating, said system comprising, first and second pneumatically pressurizeable and ventable reservoirs for alternately and oppositely delivering and receiving said electrolyte, conduits connecting said inlet and outlet means with said reservoirs;

a source of pneumatic pressure; and means for alternately and oppositely pressurizing and venting said reservoirs to effect said shuttling.

2. An electroplating apparatus for the rapid incremental deposition of metal along the surface of a workpiece to be plated comprising:

an enclosure defining an open-ended cavity having a central axis extending therethrough with said ends aligned on said axis, said enclosure being adapted to position said workpiece in said cavity such that said surface to be plated parallels said axis;

a first cap sealingly engaging said enclosure and defining a first electrolyte chamber at, and open to, one end of said cavity;

a second cap sealingly engaging said enclosure and defining a second electrolyte chamber at, and open to, the other end of said cavity;

an anode spaced from said surface by a predetermined gap and adapted to reciprocate between said chambers while traversing said cavity in the direction of said axis so as to effect electroplating of substantially only that portion of said surface which is immediately adjacent said anode as it traverses said cell;

means for reciprocating said anode; and a pneumatic system for shuttling said electrolyte back and forth between said chambers and through said gap during plating; said system comprising first and second pressurizeable and ventable reservoirs for alternately and oppositely delivering and receiving said electrolyte;

conduits between said cell and said reservoirs for conducting said electrolyte therebetween;

a source of pneumatic pressure; and control means for alternately and oppositely pressurizing and venting said reservoirs to effect said shuttling in timed relation to the movement of said anode through said cavity.

3. An electroplating apparatus for the rapid incremental deposition of metal along the surface of a workpiece to be plated comprising:

an enclosure defining the open-ended cavity having a central axis extending therethrough with said ends aligned on said axis, said enclosure being adapted to position said workpiece in said cavity such that said surface to be plated parallels said axis;

a first cap sealingly engaging said enclosure and defining a first electrolyte chamber at, and open to, one end of said cavity;

a second cap sealingly engaging said enclosure and defining a second electrolyte chamber at, and open to, the other end of said cavity;

an anode spaced from said surface by a predetermined gap and adapted to reciprocate between said chambers while traversing said cavity in the direction of said axis so as to effect electroplating of substantially only that portion of said surface which is immediately adjacent said anode as it traverses said cell; means for reciprocating said anode; and a pneumatic system for shuttling said electrolyte back and forth between said chambers and through said gap during plating; said system comprising first and second pressurizeable and ventable reservoirs for alternately and oppositely delivering and receiving said electrolyte;

conduits between said cell and said reservoirs for conducting said electrolyte therebetween;

a source of pneumatic pressure, and automatic control means for alternately and oppositely pressurizing and venting said reservoirs to effect said shuttling in timed relation to the movement of said anode through said cavity and such as to reverse the direction of electrolyte flow through said gap when the anode direction reverses so as to cause said electrolyte to move through the cell in a direction opposite to the anode's direction of movement.

4. In a method of operating a flow-through electroplating cell including a cathodically polarized workpiece, an anode spaced from said workpiece by a gap through which electrolyte flows during plating and cell inlet and outlet means for continuously providing and withdrawing electrolyte to and from said cell, the improvement comprising during plating repeatedly:

pneumatically expelling said electrolyte from a first pressurized and ventable reservoir through said gap in one direction and into a second pressurizeable and vented reservoir;

accumulating said electrolyte in said second reservoir; and thereafter venting said first reservoir and pneumatically pressurizing said second reservoir to expel said electrolyte from said second reservoir through said gap and return it to said first reservoir;

whereby said electrolyte is pneumatically shuttled back and forth between said reservoirs through said gap so as to provide fresh flowing electrolyte in the gap at all times.

5. In a method of operating a flow-through electroplating cell including a cathodically polarized workpiece, a reciprocating anode spaced from said workpiece by a gap through which electrolyte flows during plating and cell inlet and outlet means for continuously providing and withdrawing electrolyte to and from said cell, the improvement comprising during plating repeatedly:

pneumatically expelling said electrolyte from a first pressurized and ventable reservoir through said gap in one direction and into a second pressurizeable and vented reservoir;

accumulating said electrolyte in said second reservoir;

thereafter reversing the direction of electrolyte flow by venting said first reservoir and pneumatically pressurizing said second reservoir to expel said electrolyte from said second reservoir through said gap in the opposite direction and return it to said first reservoir; and automatically coordinating said flow reversal with the direction reversals of said anode such that said electrolyte always flows through the gap in the opposite direction to the direction of the anode;

whereby said workpiece is incrementally plated as said electrolyte is pneumatically shuttled back and forth through said gap and between said reservoirs providing fresh flowing electrolyte in the gap and minimizing polarization effects within the cell.

* * * * *